340-565 SR
11/18/86 XR 4,623,878

United States Patent [19]
Schoenwetter

[11] Patent Number: 4,623,878
[45] Date of Patent: Nov. 18, 1986

[54] CHRISTMAS TREE MOUNTED SMOKE DETECTOR

[76] Inventor: Henry Schoenwetter, P.O. Box 16144, Plantation, Fla. 33318

[21] Appl. No.: 393,103

[22] Filed: Jun. 28, 1982

[51] Int. Cl.[4] ..... G08B 17/10; G08B 21/00
[52] U.S. Cl. ..... 340/628; 340/522; 340/566; 340/629; 428/7; 428/18
[58] Field of Search ..... 340/629, 604, 628, 506, 340/566, 522; 248/304; 220/18; 428/7, 18, 19, 20, 65; 200/157; 307/130; 362/123; 211/196, 205

[56] References Cited

U.S. PATENT DOCUMENTS

| | | | |
|---|---|---|---|
| 750,742 | 1/1904 | Weston | 220/18 X |
| 2,522,020 | 9/1950 | Deyo | 169/26 |
| 2,628,054 | 2/1953 | Fazakerley | 248/308 |
| 3,004,248 | 10/1959 | Appel | 340/593 |
| 3,277,291 | 10/1966 | Holbrook | 248/304 X |
| 3,500,368 | 3/1970 | Abe | 340/629 X |
| 3,777,423 | 12/1973 | Coulter et al. | 340/629 X |
| 3,778,800 | 12/1973 | Blackwell et al. | 340/636 |
| 3,842,409 | 10/1974 | Mayer | 340/629 |
| 3,916,209 | 10/1975 | Steele et al. | 340/630 X |
| 3,935,956 | 2/1976 | Sansanelli | 248/359 X |
| 4,227,190 | 10/1980 | Kelley et al. | 340/604 |
| 4,236,822 | 12/1980 | Jaretsky et al. | 340/628 X |
| 4,238,788 | 12/1980 | Rosauer et al. | 340/629 X |
| 4,255,746 | 3/1981 | Johnson et al. | 307/130 X |
| 4,401,979 | 8/1983 | Dobrzanski | 340/628 X |
| 4,417,235 | 11/1983 | Del Grande | 340/628 X |

*Primary Examiner*—Charles A. Ruehl
*Assistant Examiner*—Daniel Myer
*Attorney, Agent, or Firm*—Oltman and Flynn

[57] ABSTRACT

A smoke alarm mounted atop a Christmas tree, where an early indication of an impending fire may be generated. The alarm has built-in ionization chamber for smoke detection, control circuits for operating the ionization chamber and circuitry for processing and interpreting the output signals from the ionization chamber. In case of smoke detection, the control circuit operates a loudspeaker to generate a loud audible signal. The smoke alarm also has provisions for mounting atop a door. In an expanded version, the smoke alarm incorporates an intrusion alarm that is connected with a vibration detector with control circuits that operates the loudspeaker to produce a loud audible signal in case of tampering with the door. The alarm has provisions for self-checking the status of the built-in batteries and a light indicator shows if the batteries need replacement. A manual push button provides means for testing the smoke.

4 Claims, 8 Drawing Figures

CHRISTMAS TREE MOUNTED SMOKE DETECTOR

BACKGROUND OF THE INVENTION

The invention relates generally to alarm systems for fire and burglary, in particular for fire in Christmas trees.

The fire hazard associated with illuminated Christmas trees that are displayed during the Christmas season, and often left unattended while connected to the electric power line, has long been recognized. The hazard stems from the facts that the trees are usually in a very dried-out condition and therefore very vulnerable to being ignited, and once ignited, they burn with an intensity that makes quick action necessary if disaster shall be averted. Even artificial trees are subject to electrical fires.

Fire detecting and alarming apparatus has been well known and used for a long time. Early fire detectors were based on the rapid temperature rise in a room exposed to fire, as detected by suitable temperature sensors positioned near the ceiling. Fire and smoke detectors of more recent years make use of other more sensitive sensing methods. One of these methods employs the reflection of light from finely dispersed smoke particles in a light beam, as seen by a sensitive photo diode. Another method employs the detection of ionized air which develops whenever a fire occurs.

PRIOR ART

Several inventors have in the past addressed the problem of protecting against fire, burglary and other hazards.

U.S. Pat. No. 2,522,020 by L. C. Deyo, entitled Automatic Christmas Tree Fire Extinguisher, issued Sept. 12, 1950 describes a reservoir of fire extinguishing fluid disposed above and in the vicinity of a Christmas tree and equipped with a low temperature melting solder joint, which, when heated released a spring which in turn breaks the bottom of the fluid container which releases its contents to extinguish the flames.

U.S. Pat. No. 3,004,248 by A. L. Appel issued Oct. 10, 1961 discloses a combined Burglar and Fire Alarm configured so that it may be attached to window screens and doors. The fire alarm section uses a bimetallic strip of material to detect a temperature rise, and a vibration sensitive spring serves to transmit a vibrating motion to a part of contacts which may turn on a compressed air horn.

U.S. Pat. No. 4,227,190 by J. K. Kelley, entitled Water Alarm for Monitoring Floor Moisture and issued Oct. 7, 1980, describes a donut-shaped enclosure housing so that it may be dropped over the top of an upwardly projecting standpipe and come to rest on the floor surrounding the standpipe. It has feet resting on the floor. The feet are connected with moisture sensing electrodes that, in the case of moisture on the floor, activates a battery operated horn contained within the alarm enclosure.

U.S. Pat. No. 3,842,409 by R. H. Mayer, entitled Ionization Detector Apparatus, issued Oct. 15, 1974 describes a fire warning apparatus which employs pulsed timing apparatus connected with an ionized air detector to guard against untimely alarms. The invention further comprises a visual indicator to warn of a failing battery and a test button to test the operation of the invention. It further comprises a sensitivity adjustment button for selectively adjusting the degree of ionized air required to initiate an alarm.

U.S. Pat. No. 3,778,800 by L. L. Blackwell, entitled Self-Monitoring Battery Operated Circuit, issued Dec. 11, 1973, describes a battery monitoring circuit that is capable of issuing an audible alarm when the battery of an associated device, such as a smoke alarm, has been depleted to the point when replacement is indicated.

SUMMARY AND OBJECTS OF THE INVENTION

The present invention relates to combined fire and burglar alarm devices. It is especially aimed at alarming the start of a Christmas tree fire by being specially configured so as to be positioned atop a Christmas tree by dropping the toroidally configured enclosure over the top of a Christmas tree where it is ideally positioned to detect the very earliest traces of an impending fire. Furthermore, since much of the apparatus and components involved in the construction of a smoke alarm invention, with little additional apparatus, according to the invention, it may also be configured as an intrusion alarm. The invention incorporates both of these functions in a single unitary construction.

Further, many people who travel and stay in hotel rooms often fear the two evils of fire or burglary while they sleep there.

It is therefore a primary object of the invention to provide a smoke detector that is well suited to be used as a Christmas tree smoke alarm that may be dropped over the top of a Christmas tree where it will provide an early alarm, in case a fire should start somewhere on the Christmas tree.

It is another important object of the invention to provide a general purpose smoke detector that may be located anywhere in a room to provide an alarm in case a fire should start somewhere in the room.

It is still another important object of the invention to provide a general purpose combined smoke and intrusion detector that may be positioned in contact with a door or a window to provide an alarm in case the door or window is tampered with and also in case a fire should start in the vicinity.

It is still a further object of the invention to provide a combined smoke and intrusion detector that does not depend on commercial ac-power for its operation, by using portable built in batteries.

It is still another object of the invention to provide a combined smoke and intrusion detector that has means for indicating if the batteries have lost their power.

It is still further an object of the invention to provide a combined smoke and intrusion detector that may be tested for proper operation by operating an external push button to initiate an audible verification thereof.

It is still another important object of the invention to provide a combined smoke and intrusion detector that has means for remotely located alarm indicator.

It is another object of the invention to provide a combined smoke and intrusion detector that is reliable in operation and is relatively simple and inexpensive to manufacture.

DETAILED DESCRIPTION OF THE INVENTION

Before proceeding to the detailed description of the invention, it should be understood that it is described in one of its more preferred embodiments. It is capable, however, of other embodiments that may be obvious to those skilled in the art and that fall within the scope of its inventive concept. Also the terminology used therein is only for purposes of description and not for limitation.

The description is based on the assumption that the invention is positioned in a generally horizontal plane, with the top cover on the upper side, but in actual operation it may be positioned in almost any other orientation.

Figure 1:
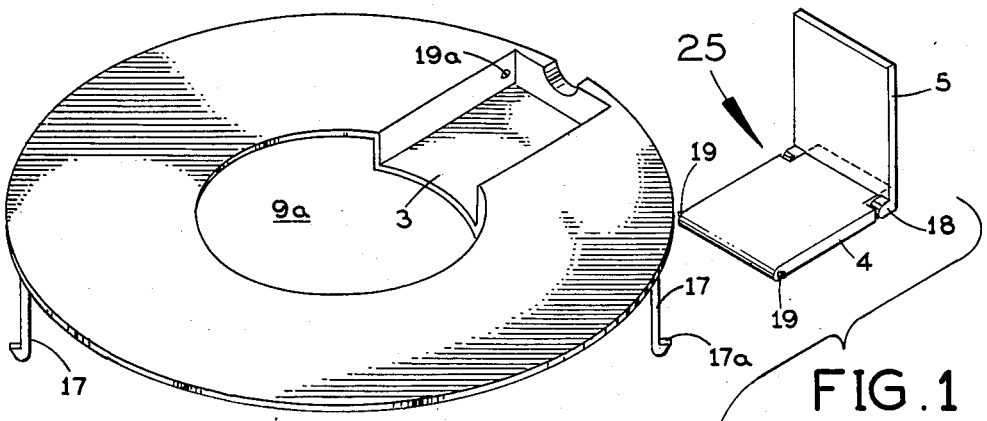
FIG. 1 is a perspective exploded view of the enclosure containing the invention, showing the circular main body, the top cover and the mounting bracket.

FIG. 1 shows in perspective an exploded view of the generally toroidal enclosure consisting of an outer vertical cylindrical wall 1, a circular horizontal bottom plate generally at 47, an inner vertical cylindrical wall 6 and a circular, detachable, horizontal top plate 2, the latter having a circular concentric opening, generally at 9*a*.

The circular bottom plate 47 has a circular, concentric opening generally at 9*b* which corresponds to the circular opening 9*a* in the top plate 2.

The outer cylindrical wall 1 together with the inner cylindrical wall 6, the top circular plate 2 and the bottom circular plate 47 are shells that define an inner toroidal space generally at 24, which encloses the apparatus and components of the invention.

The inner cylindrical wall 6 defines an inner cylindrical space, generally at 21.

The outer cylindrical wall 1 and the circular bottom plate 47 are perforated with a multitude of openings, reference 7 in the cylindrical wall 1 and reference 8 in the bottom plate 47, which allow the surrounding air to migrate freely through the inner toroidal space 24.

Two vertical flexible legs 17 integral with the top plate 2 and projecting downward therefrom, have outward facing hooks 17*a*.

The downward projecting legs 17 are coordinated with two apertures 23 in the bottom plate 47 (FIG. 2), such that the enclosure is assembled by aligning the top plate 2 with the cylindrical wall 1 and aligning the legs 17 with the apertures 23 and forcing the top plate downward with the legs 17 slightly bent inward and inside the cylindrical wall until the lower ends of the legs 17 protrude through the apertures 23. At the moment the hooks 17*a* clear the lower surface of the bottom plate, they spring outward and hold the top plate 2 closely attached to the bottom plate.

Figure 4:
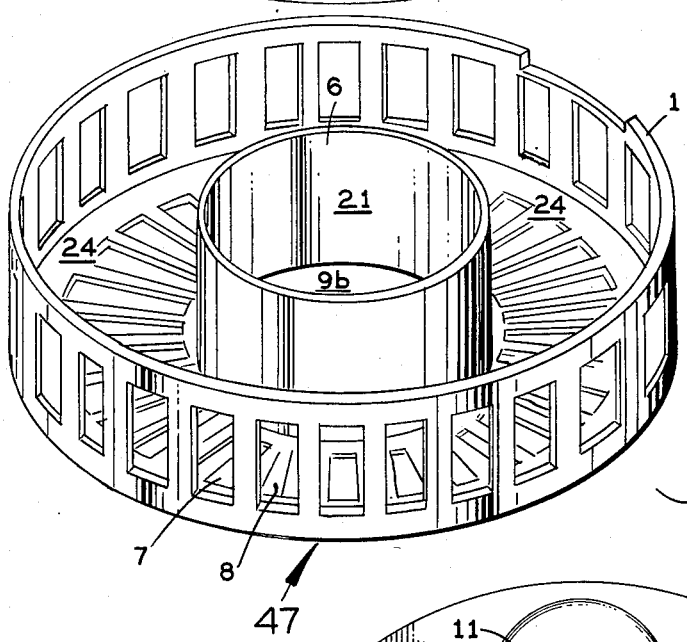
FIG. 4 is a fragmentary cross-sectional, vertical view of the main body of the invention with the mounting bracket unfolded, seen along the line 4—4 of FIG. 2.
Figure 4:
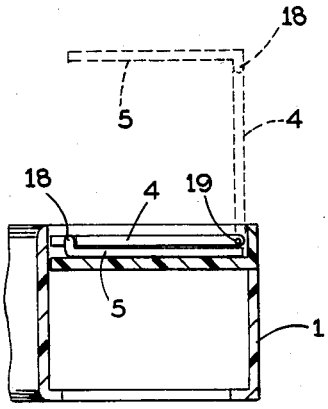

A folding mounting bracket generally at 25 in FIG. 1 is hingedly attached to the top plate 2 by means of hinge pins 19 in first hinge plate 4 which, when assembled with the top plate 2, are inserted into holes 19*a* in the vertical sides of a recess 3 in top plate 2. When folded, the mounting bracket is received in its position in the recess 3 and is then flush with the top surface of top plate 2. When the bracket is unfolded, as shown in phantom lines in FIG. 4, first hinge plate 4 is swung out to a position which is 180° from its folded position. A second hinge plate 5 is hingedly attached by hinge pin 18 to first hinge plate 4. When folded, second hinge plate 5 swings out to a position that is perpendicular to first hinge plate 4.

Figure 6:
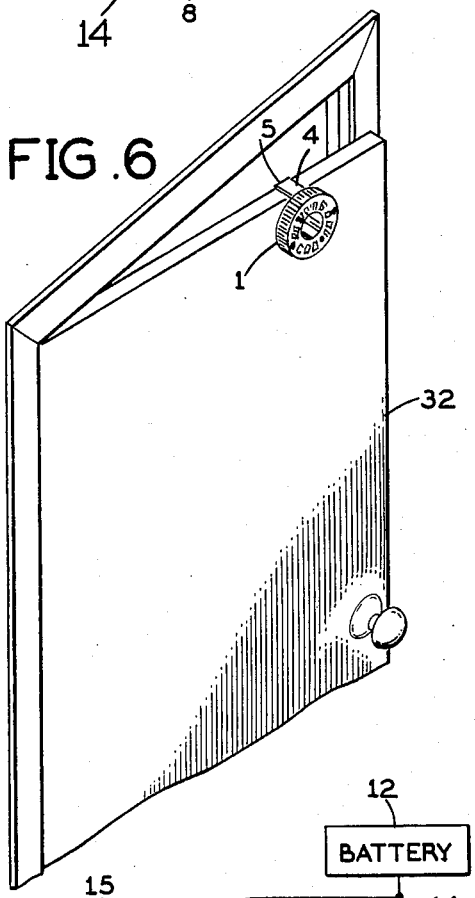
FIG. 6 shows the invention installed on top of a door.

This form of installation is shown in FIG. 6, where the invention is installed atop a door 32. In this position the alarm is in contact with the door, where it will detect any vibration resulting from tampering with the door, and it is positioned close to the ceiling where it will detect smoke from a fire inside the room.

Figure 2:
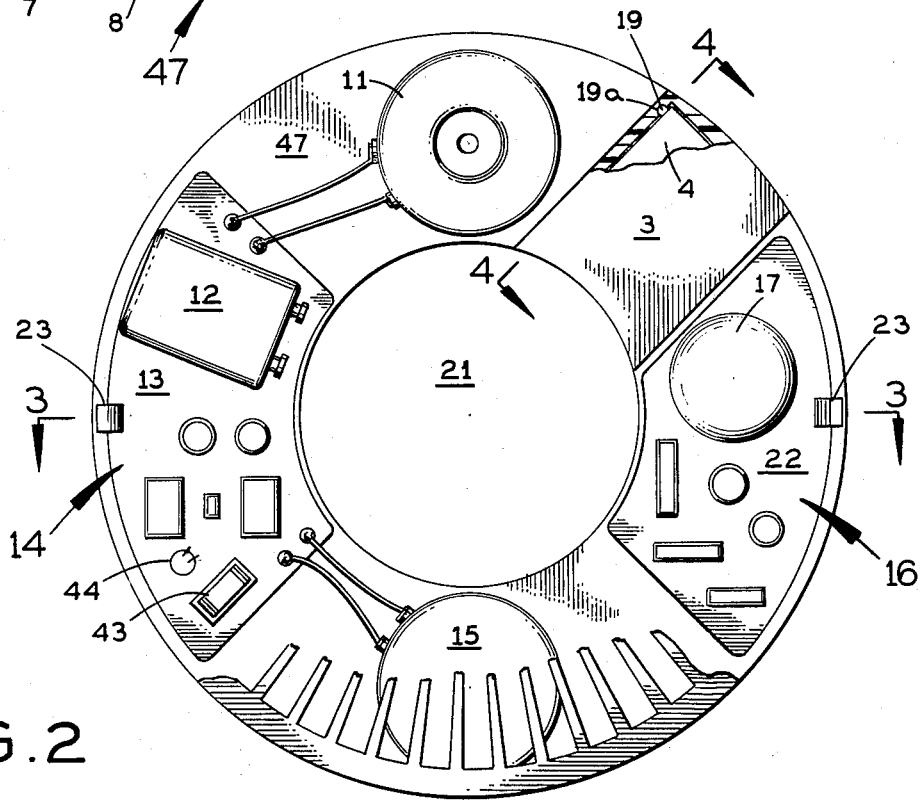
FIG. 2 is a top-down horizontal view of the interior of the apparatus with the top cover removed.

The main parts of the invention, consisting of the smoke detector with its components generally at 14 and the intrusion detector with its main components, generally at 16, are shown in FIG. 2.

The smoke detector's main part is an ionization chamber 15 which is connected to the control circuit generally at 14. The detecting circuitry consists of small components such as resistors, capacitors, integrated circuits and the like. These components are mounted on a printed circuit board 13, which also holds a battery 12.

Smoke detecting circuits per se have been known and used for a long time, and are described in publications. As an example, several types of smoke detecting circuits, are described in CMOS Integrated Circuits by Motorola Technical Information Center, Series C, third printing in October, 1978. This reference describes several integrated circuits designed to operate with ionization chambers. These circuits also include provisions for automatic testing of the battery voltage and for operating a loud speaker where the battery voltage goes too low for reliable operation.

Although the present embodiment of the invention employs an ionization chamber for smoke detection, it could use other types of smoke sensing systems. One other such system is based on the principle of evaluating the amount of light that is reflected from minute smoke particles suspending in the air when subjected to light from a light emitting diode (LED) and using a wide area silicon diode as light detector. Such a system is also described in the above reference. The components of the intrusion circuit are mounted on a printed circuit board 22. The major component 17 is a vibration sensing device generally known as a microphone. A microphone, of which there are many well known types, such as dynamic crystal, carbon granule, electrostatic and so on, is constructed to detect minute acoustic vibrations and translate them into an electrical signal. An amplifying circuit consisting of conventional electronic components such as integrated circuits resistors and diodes serve to amplify the output signal from the microphone and connect the amplified signal to trigger an audible alarm. In the present embodiment, the audible alarm device is the loudspeaker 11, which is shared between the intrusion detector and the smoke detector. The audible alarm could be a voice signal.

Intrusion alarms based on the use of a microphone connected to an amplifier which in turn triggers an audible alarm, have been known and used for a long time. The present invention is not directed to the method of constructing such an intrusion alarm per se, and shall not be described here in any greater detail.

Figure 3:
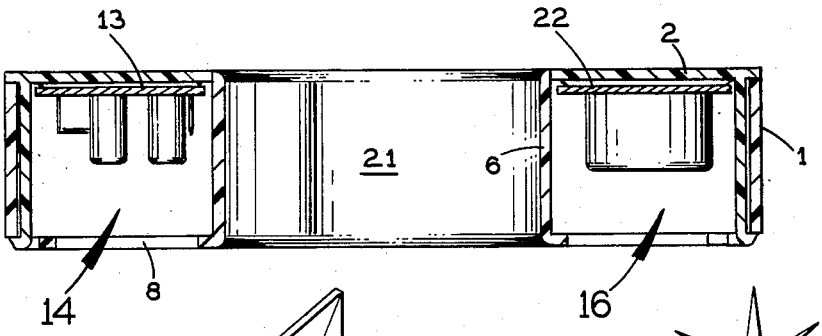
FIG. 3 is a vertical cross-sectional view through the main body of the invention along the line 3—3 of FIG. 2.

FIG. 3 is a vertical cross-sectional view of the invention along the line 3—3 of FIG. 2. It shows the printed circuit board 13 of the smoke alarm section attached to the top plate 2 and supporting the electronic components thereof, generally at 14 and the printed circuit board 22 of the intrusion alarm section, also attached to the top plate 2, and supporting the electronic components thereof, generally at 16.

Figure 8:
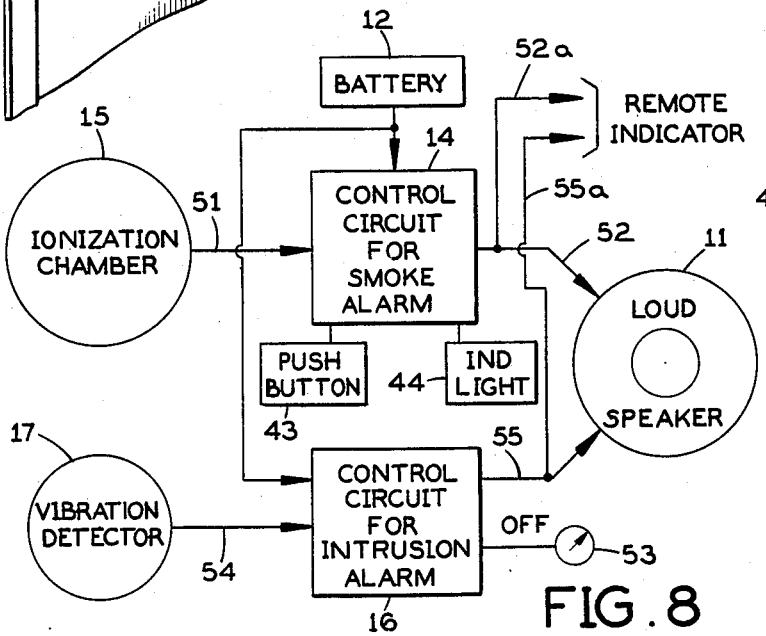
FIG. 8 is a block diagram of the invention showing its major functional blocks.

The present invention, in the preferred embodiment consisting of a Christmas tree smoke alarm combined with an intrusion alarm as shown in block diagram form in FIG. 8, which shows how the various major functional blocks of the invention are mutually interconnected.

The ionization chamber 15, in case smoke is present, detects the smoke by means of ionized air molecules contained in the smoke, and produces an output signal on its output lead 51, connected to the control circuit 14 for the smoke alarm. The control circuit processes and interprets the signal, and in the case of smoke being present, the control circuit 14 produces an output signal on its output lead 52 which is connected to loudspeaker 11. The loudspeaker produces a loud audible signal which will alert individuals present of impending fire hazard.

The control circuit 14 may have an optional terminal 52*a* which is a branch of 52, that may be connected to a space remotely located loudspeaker or a remote indicator. A push-button 43 which is accessible from the underside of the enclosure as seen on FIG. 5 serves to test the system for proper operation. Operation of the test button 43 will cause the smoke detector to emit a momentary burst of audible signal to indicate that the system is operable.

A light indicator 44 serves to indicate the condition of low battery voltage.

The intrusion detector consists of the vibration indicator 17 which is generally, as described above, a suitable microphone, as described above, connected at its output lead 54 to the control circuit 16 for intrusion alarm. The control circuit 16 processes and interprets the output signal in a manner well known from such systems. If the control circuit "determines" that intrusion is in progress, it triggers an audible alarm circuit connected by output lead 55 to the loudspeaker 11, which produces a loud audible signal.

The smoke detector of this invention is not intended to take the place of a conventional smoke detector. It may be used in conjunction with a conventional smoke detector.

The center opening 21 could be other than a round shape if desired.

A manual sensitivity control knob 53 serves to control the sensitivity of the control circuit 16 such that it will not respond to incidental minor noise signals, but is still sensitive enough to respond to signals produced by tampering with the door or window to which it is attached.

The sensitivity control knob 53 also serves to disable the intrusion alarm circuit when its operation is not desired. Disabling is effected by turning the control knob 53 all the way in counterclockwise direction until a stop is reached, as indicated by the position OFF in FIG. 8.

The intrusion alarm control circuit 16 may have an output terminal 55*a*, which is a branch of the output lead 55 and which may be connected to a remotely located loudspeaker or other indicating means.

Figure 5:
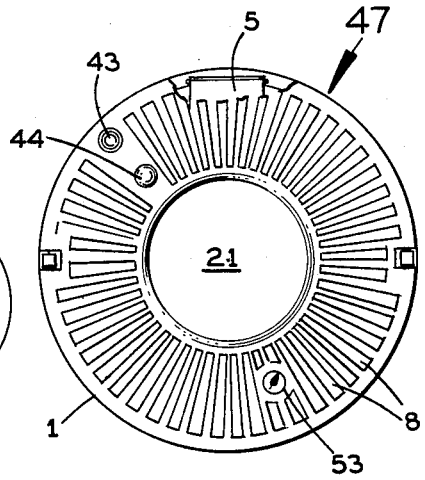
FIG. 5 is a bottom view of the invention with the mounting bracket unfolded.

The sensitivity control knob 53 is accessible from the underside of the alarm enclosure 1 as seen in the bottom view, FIG. 5.

FIG. 6 shows the alarm mounted on the top edge of a door, from where it hangs by its unfolded support bracket, plates 4 and 5.

Figure 7:
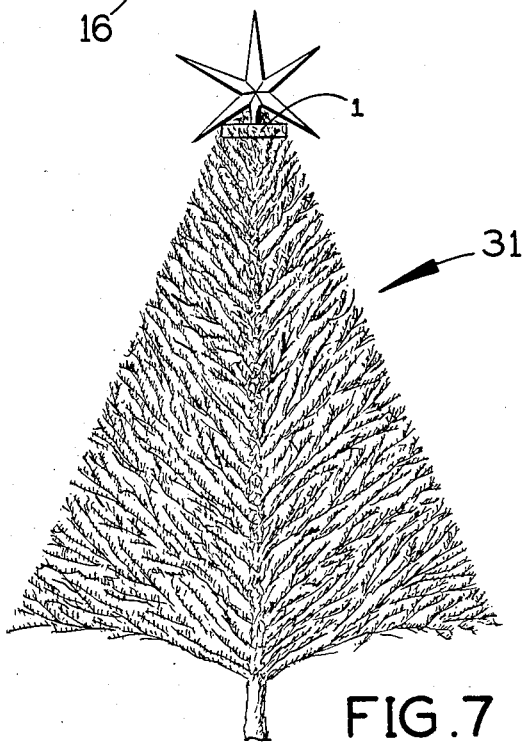
FIG. 7 shows the invention installed on top of a Christmas tree.

FIG. 7 shows the alarm mounted atop a Christmas tree, generally at 31. In this location, the alarm is in a position that is well suited to detect the earliest traces of smoke from an impending fire.

I claim:

1. A smoke detector for releasaby mounting on the top stem of a Christmas tree comprising:

a hollow toroidal enclosure having a generally horizontal annular bottom wall with a central opening, a generally horizontal annular top wall with a central opening aligned with said opening in the bottom wall, an annular inner wall extending up from said bottom wall to said top wall at said central openings therein for receiving the top stem of a Christmas tree, and an annular outer wall extending up from the outer periphery of said bottom wall to the outer periphery of said top wall, said toroidal enclosure having additional openings therein;

a smoke sensor inside said toroidal enclosure operatively arranged to detect smoke passing through said additional openings;

and audible signalling means inside said toroidal enclosure operatively connected to said smoke sensor to produce an audible alarm signal in response to the detection of smoke by said smoke sensor.

2. A smoke detector according to claim 1 wherein said additional openings are in said bottom wall and said outer wall of said toroidal enclosure.

3. A smoke detector according to claim 2 wherein:

said bottom wall and said inner and outer walls of said toroidal enclosure form an integral structure;

and said top wall is formed separate from said bottom wall and said inner and outer walls and is releasably attached to said integral structure.

4. A smoke detector according to claim 1 and further comprising:

a microphone mounted inside said toroidal enclosure and operatively arranged to sense acoustic vibrations;

and a control circuit operatively connecting said microphone to said audible alarm signalling means for producing an audible alarm signal when said microphone senses acoustic vibrations.

* * * * *